US005937659A

United States Patent [19]

Weyna et al.

[11] Patent Number: 5,937,659

[45] Date of Patent: Aug. 17, 1999

[54] OIL VISCOSITY CONTROL METHOD/ SYSTEM FOR A REFRIGERATION UNIT

[75] Inventors: Paul V. Weyna, Manlius; Mark Fragnito, Cicero; John R. Reason, Liverpool; L. Thomas Lane, Manlius, all of N.Y.

[73] Assignee: Carrier Corporation, Syracuse, N.Y.

[21] Appl. No.: 09/058,320

[22] Filed: Apr. 9, 1998

[51] Int. Cl.[6] ..... F25B 43/02

[52] U.S. Cl. ..... 62/84; 62/193; 62/228.5

[58] Field of Search ..... 62/84, 195, 190, 62/193, 228.5, 228.1, 468

[56] References Cited

U.S. PATENT DOCUMENTS 5,062,277 11/1991 Heitmann et al. ..... 62/193
5,195,327 3/1993 Kim ..... 62/84

*Primary Examiner*—John M. Sollecito

[57] ABSTRACT

A method for controlling oil viscosity in a refrigeration unit having an oil viscosity effecting parameter with a desired set point. The refrigeration unit includes an oil lubricated compressor having a capacity and a suction pressure, a condenser, refrigerant control valves, and an evaporator connected in series, for circulating a refrigerant for adjusting air temperature of a compartment. The method comprises the steps of measuring the parameter; controlling viscosity level of said oil so as not to interfere with proper operation of the compressor, including the steps of: setting a parameter range inclusive of the desired set point in which parameter is desired to fall, said range having a high point and a low point, wherein with said parameter in said range, viscosity of the oil is substantially at a desired level; cooling the air if based on said step of measuring the parameter is higher than said high point; heating the air if based said step of measuring the temperature is lower than said low point; and maintaining said air temperature if based on said means for sensing the parameter is within said desired range and toward said set point. A related system for oil viscosity control is also disclosed.

18 Claims, 4 Drawing Sheets

OIL VISCOSITY CONTROL METHOD/ SYSTEM FOR A REFRIGERATION UNIT

TECHNICAL FIELD

This invention is directed to control methods/systems for refrigeration units, and more particularly, to an oil viscosity control method/system operable to maintain compressor oil viscosity at a desired maximum, specifically for transport refrigeration unit applications.

BACKGROUND ART

Current refrigeration systems used in transport applications, specifically truck and trailer refrigeration units, have designs which allow oil viscosity to get very high as the refrigeration compartment progressively cools. Refrigeration systems continue to run, even with the compressor capacity reduced to the fullest extent, reducing the refrigeration compartment up to 60° F. below the frozen set point. As a result, oil viscosity is caused to climb to 6000 cSt or higher. This extremely high oil viscosity has a negative impact on compressor performance.

Specifically, the compressor suction valve suffers from reduced reliability. The very cold, highly viscous oil of current systems causes adhesion between the suction valve and the valve plate, thus delaying the valve opening until the suction pressure is high enough to overcome the adhesion force. Upon valve opening, the suction valve experiences a high initial velocity and momentum, causing the valve to contact the valve stop with higher force than normal or than preferred. Upon contact with the stop, the valve bends into the cylinder, thus increasing stress which can ultimately lead to valve failure.

There is a need therefore, for a system for controlling/limiting compressor oil viscosity at a desired level in refrigeration systems, specifically those used in transport refrigeration.

DISCLOSURE OF INVENTION

The primary object of this invention is to provide a system/method for controlling the viscosity of oil to a desired/optimal level in refrigeration systems.

Another object of this invention is to provide a system/method to control the viscosity of oil in transport refrigeration systems by maintaining the temperature in the refrigeration compartment in a desired vicinity of the desired freezing set point temperature (SPT) and by raising the evaporator and suction pressure.

Another object of this invention is to provide a system/method to control oil viscosity to a reasonable level in a compressor of a transport refrigeration system by preventing cooled return air temperature (RAT) from dropping in temperature more than within a given range of an ideal temperature below the SPT, in both the continuous run and start/stop modes and by raising the evaporator and suction pressure to within a desired range.

Still another object of the present invention is to provide a system to control the viscosity of oil in transport refrigeration systems by controlling the suction pressure in the evaporator to remain within a desired range, thereby maintaining RAT and the refrigerant-in-oil percentage within a desired range.

The foregoing objects and following advantages are achieved by the method of the present invention for controlling oil viscosity in a refrigeration unit having an oil viscosity effecting parameter with a desired set point. The refrigeration unit includes an oil lubricated compressor having a capacity and a suction pressure, a condenser, refrigerant control valves, and an evaporator connected in series, for circulating a refrigerant for adjusting air temperature of a compartment. The method comprises the steps of measuring the parameter; controlling viscosity level of said oil so as not to interfere with proper operation of the compressor, including the steps of: setting a parameter range inclusive of the desired set point in which parameter is desired to fall, said range having a high point and a low point, wherein with said parameter in said range, viscosity of the oil is substantially at a desired level; cooling the air if based on said step of measuring the parameter is higher than said high point; heating the air if based said step of measuring the temperature is lower than said low point; and maintaining said air temperature if based on said means for sensing the parameter is within said desired range and toward said set point. A related system for oil viscosity control is also disclosed.

DETAILED DESCRIPTION OF THE PREFERRED EMBODIMENT

Figure 1:
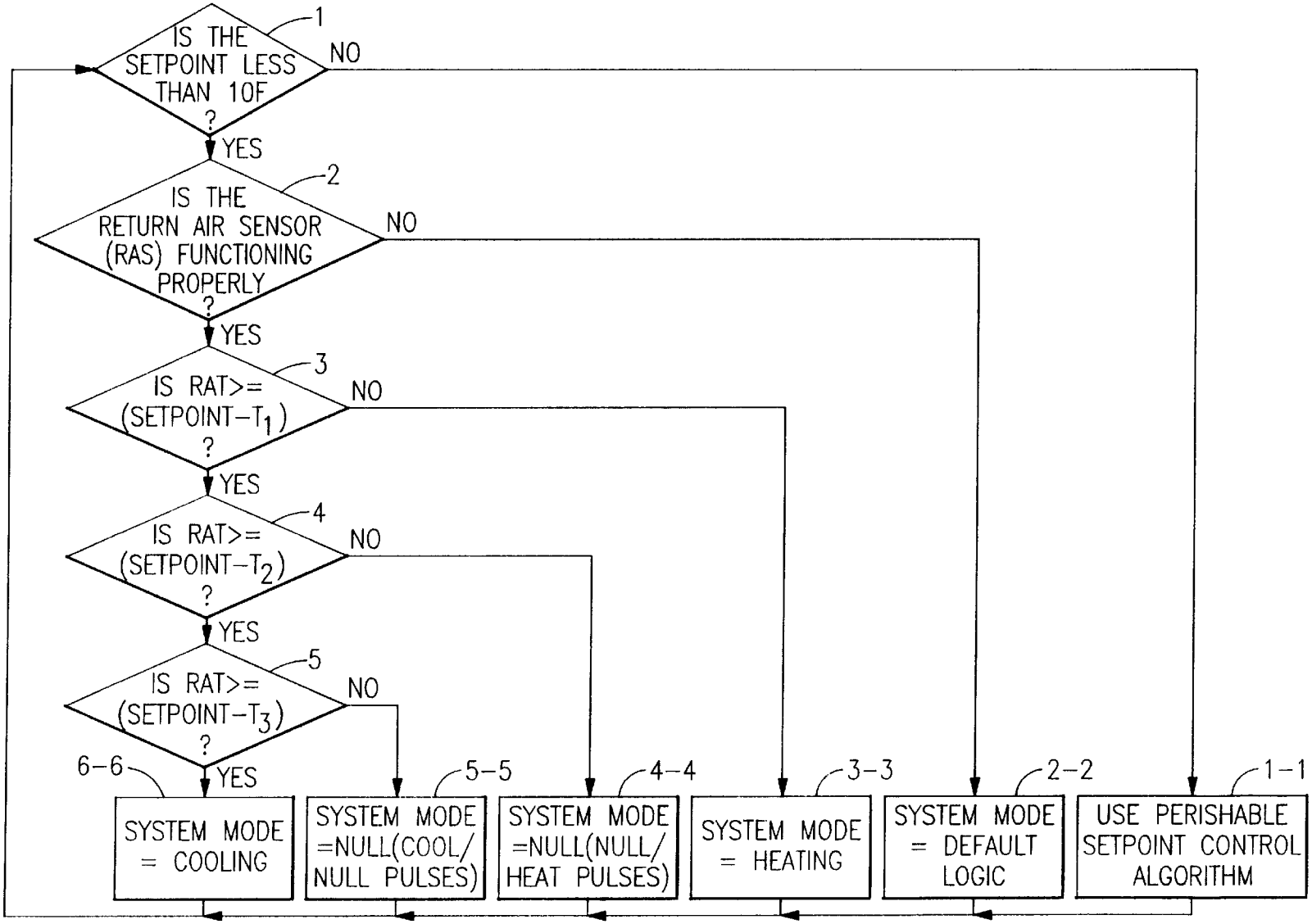
FIG. 1 is a flow diagram of the steps of the method of the present invention for controlling oil viscosity in a refrigeration system.
Figure 2:
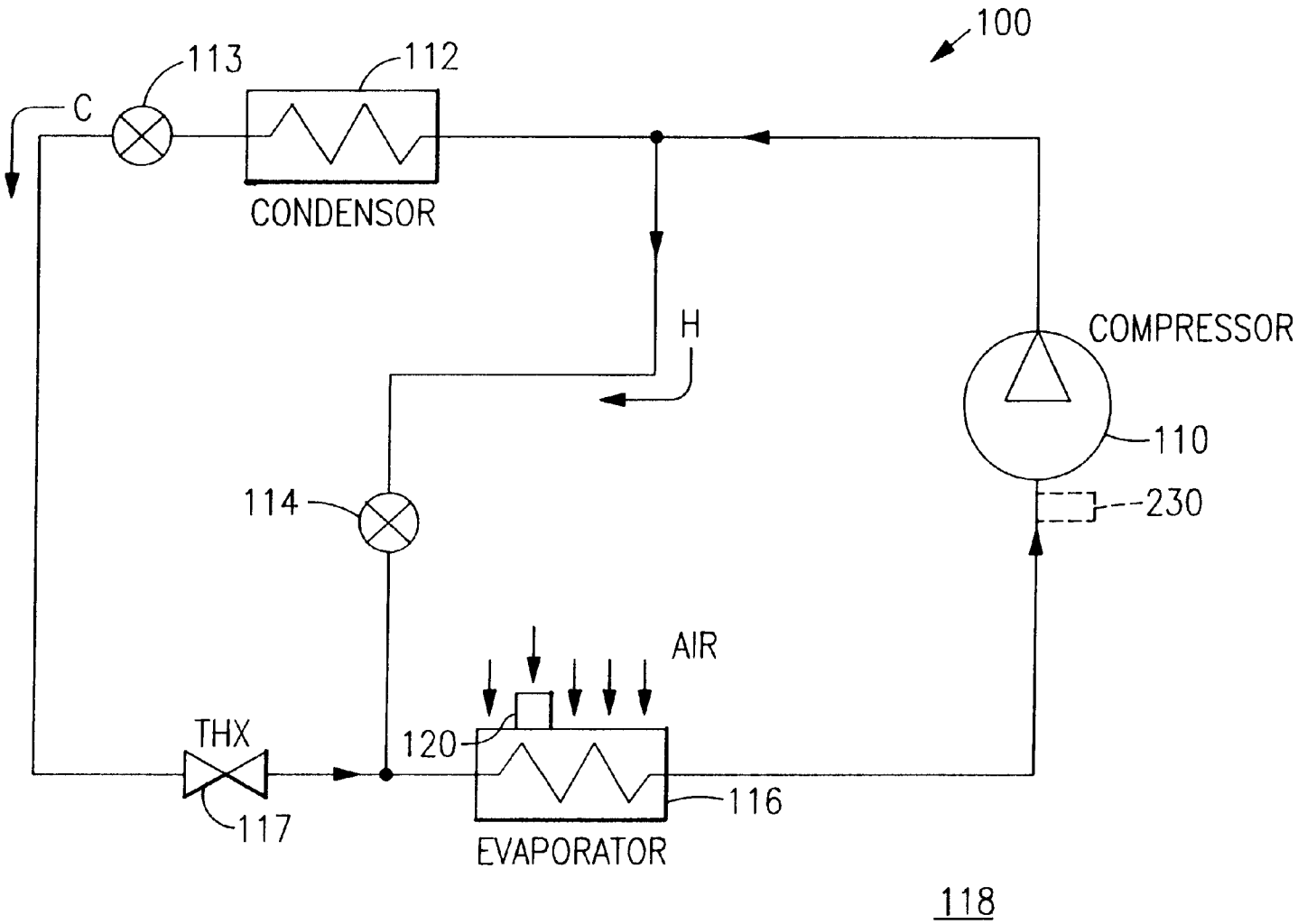
FIG. 2 is a schematic diagram of a typical refrigeration system for use with the method and system of the present invention.

Referring now to the drawings in detail, there is shown in FIG. 1 a flow chart of the method/system of the present invention for use in maintaining oil viscosity at a preferred level in a refrigeration system. The method/system of the present invention is preferably software or electronically based and preferably functions with the overall continuous run control of a refrigeration system, and is preferably for transport refrigeration applications. A refrigeration system 100 for use with the method and system of the present invention is shown in FIG. 2, and includes an oil lubricated compressor 110 having a capacity and a suction pressure, a condenser 112, refrigerant control/hot-gas valve 113 in the cooling loop C, refrigerant control/hot-gas valve 114 in the heating loop H, a thermal expansion valve (THX) 117 and an evaporator 116 connected in series, for circulating a refrigerant for adjusting air temperature of a compartment 118.

The primary function of the control method and system of the present invention is to control compressor oil viscosity by maintaining an oil viscosity effecting parameter such as the refrigeration unit return air temperature (RAT) in a given range. Specifically, RAT is held in a given vicinity of a set point temperature (SPT), thereby increasing suction or evaporator pressure. That is, a SPT is provided to which the refrigeration unit must be cooled for proper refrigeration of the goods being transported, and the control system of the present invention maintains the temperature of the air in the refrigeration compartment of the system within a chosen range around the desired SPT, while at the same time raising suction or evaporator pressure. Through maintenance in this chosen range, compressor suction temperature, pressure and compressor oil viscosity can be controlled to an optimal level for safe operation of the compressor. A similar result can be achieved, as discussed below, by maintaining an oil-viscosity effecting parameter such as the suction pressure in a desired range. The relationship between oil viscosity and oil temperature and suction pressure, refrigerant-in-oil (RIO) percentage, and air temperature is shown, for a specific embodiment discussed in more detail below, in the Daniel Plot of FIG. 3. PA indicates the location on the plot of these parameters using the prior art system, yielding a RAT of −50° F., and I indicates the location on the plot of these parameters using the method/system of the present invention, yielding a RAT of −23° F. P is indicative of the suction pressure lines, in PSIA.

System 100 implements a return air sensor (RAS) 120 for sensing the temperature of the cooled air returned to the refrigeration system for refrigerating the goods being transported. As indicated in the flow chart of FIG. 1, and as discussed below, if the SPT is less than a given temperature, a perishable set point control method is used, which is not discussed in detail here.

The frozen range SPT is typically +10° F. to −20° F. By controlling the RAT to within a given range below the SPT, the viscosity of the oil can be maintained at an acceptable level for the compressor, for example 600 cSt, since at this level, and referring to FIG. 3 at I, the RIO percentage is higher at about 11–13% thereof. That is, due to the higher temperature of the oil based on the higher RAT for the system of the present invention, the oil exhibits increased solubility thereby increasing the RIO. This is a tenfold improvement in viscosity level over currently available systems, as discussed in the background, when the refrigeration unit is in the continuous run mode. Currently, the compartment of the refrigeration unit is cooled 10° to 60° F. below the SPT, causing the oil viscosity to climb to as high as 6000 cSt, as indicated by PA on FIG. 2, negatively impacting the function of the suction valve as described.

Referring still to FIG. 1, in Step 1 of the system methodology, the SPT is checked to determine if it is less than 10° F. If the SPT is not less than 10° F. then a separate perishable SPT Control System is used, which is not discussed in further detail herein. If, however, the SPT is less than 10° F., the methodology which follows is used to control RAT and compressor oil viscosity. In Step 2, where the SPT is less than 10° F., the RAS is checked to determine if it is functioning properly. If it is not functioning properly, in Sub-Step 3-3, the control system is set into default logic.

For the following description T1>T2>T3 and the system hot gas valves 113 and 114 (as shown in FIG. 2) are used to provide the described refrigerant pulses. During a maintenance stage, both cooling and heating valves 113 and 114 are opened and combine to pulse refrigerant and supply a null effect on temperature to maintain the same at or around the set point. While still in the desired range around set point, as the RAT wanders in the hot or cold direction relative the set point, the valves are adjusted to move RAT back toward set point, i.e. closing or intermittently pulsing 113 to increase heating or closing or intermittently pulsing valve 114 to increase cooling. During absolutely required heating, valve 114 is open and valve 113 is closed. During absolutely required cooling valve 113 is open and valve 114 is closed.

If the RAS is determined to be functioning properly, the control system in Step 3 then determines if RAT is greater than or equal to the SPT-T1. That is, if the RAS senses that the RAT is less than the SPT-T1, then the air is too cold and in Sub-Step 2-2, the system is placed into a heating mode, bypassing the condenser, to increase the temperature of the air and accordingly, the suction temperature/pressure. If, however, the RAT is sensed by the RAS to be greater than or equal to the SPT-T1 then in Step 4, RAT is checked to determine if it is greater than or equal to the SPT-T2 . If it is less than this temperature, then in Sub-Step 4-4 the RAT is only slightly too cold, but moving toward within range of the set point, and the system mode is set into a low capacity heating/null refrigerant pulsing, for slightly increasing the temperature of the RAT toward the desired range and set point. If, however, the system determines that the RAT sensed by the RAS is greater than or equal to the SPT-T2, Step 5-5 is invoked to further determine if the RAT is greater than or equal to the SPT-T3. If the RAT sensed is greater than or equal to the SPT-T3, then the RAT lies between T3 and T2 below the SPT, which is in the desired range. Accordingly, in Sub-Step 5-5 the system mode is set at a low capacity mode to deliver slight cooling/null refrigerant pulses, in a temperature/pressure maintenance mode, from the hot gas control valves, for maintaining the RAT and return air pressure substantially as is. If however in Step 5, the RAT as sensed by the RAS is greater then or equal to the SPT-T3, then the RAT is too warm thereby requiring the system to cool the same. Accordingly in Sub-Step 6-6, the system is placed into the cooling mode for reducing the temperature of the RAT, and also the pressure, into the desired range.

The above methodology is more specifically described below with reference to the ladder diagram of FIG. 4 and compressor operation. Applying the flow chart to this specific embodiment, T1=4.8° F., T2=3.0° F., and T3=1.56° F.

For this example, the compressor for the refrigeration system is preferably a six (6) cylinder compressor. The cooling and heating as described in Steps 1–5 above are achieved by running the compressor in the manner shown in the ladder diagram. That is, certain variations in RAT from the SPT require different levels of heating and cooling, thereby requiring the operation of the 6 cylinder compressor at different levels of capacity, as defined by the number of cylinders used and its speed of operation. As shown in the ladder diagram of FIG. 4, the SPT is shown as the upper horizontal line and the desired Continuous Run Control Point, SPT −3.0° F. is shown by the second and lower horizontal line.

For the purpose of this description, SPT is −20° F. and considered the zero point.

Starting from the left side of the diagram, in the scenario where the control temperature is falling as determined by the RAS sensing RAT, at greater than 0.24° F., all 6 cylinders of the compressor are used at high or low speed cooling mode to cool the RAT. Between a RAT of 0.24° F. and −0.66° F. relative SPT, the air is further cooled with the compressor in a low speed, reduced capacity, 4 cylinder mode. As the air further decreases in temperature to a level between the range of −0.66° F. and −1.56° F., relative SPT, the compressor capacity is further reduced by switching to a 2 cylinder, low speed mode for further but less intensive cooling. As the temperature of the air further reduces to below −1.56° F., which begins the desired range of −1.56° F. to −4.8° F. relative SPT, and while the temperature is still above the SPT −3.0° F. level, the compressor is kept in a 2 cylinder, low speed mode and cooling/null refrigerant pulses are provided via valves 113 (as shown in FIG. 2) to move the RAT down to the SPT −3.0° F. level. As the RAT reduces below SPT −3.0° F. or the Continuous Run Control Point level, the compressor is maintained in a two cylinder, low speed mode and low intensity heating/null refrigerant pulses are provided via valves 113 and 114 (as shown in FIG. 2) to slightly increase the RAT closer to the Continuous Run Control Point which raises compressor suction pressure and temperature. If the temperature further decreases below the desired range, under SPT −4.8° F., the compressor is placed in a 2 cylinder, low speed heating mode for increasing the temperature and pressure back into the desired range.

Referring now to the right hand side of the diagram where control temperature is shown as rising, when the temperature is rising but below −4.4° F. relative SPT, the compressor is set to a 2 cylinder, low speed heating mode for increasing RAT, thus raising suction temperature and pressure. Above the −4.44° F. relative SPT position, the compressor is placed in the 2 cylinder, low speed mode where low intensity heating/null refrigerant pulses, in a maintenance mode, are provided to move the temperature closer to the Continuous RunControl Point, SPT−3° F., which raises compressor suction temperature and pressure. As the air temperature further rises and is sensed to fall in a desired range, between −1.2° F. relative to SPT and the Continuous Run Control Point, SPT −3° F., the compressor is placed in the two cylinder mode, and low intensity cooling/null refrigerant pulses, in the maintenance mode, are provided to move the temperature closer to the desired Continuous Run Control Point, SPT −3° F. As the RAT is sensed to rise between −1.2° F. and −0.30° F. relative to SPT, the compressor is placed in a 2 cylinder, low speed mode for cooling the RAT down into the desired −1.20° F. to −4.44° F. range. If the temperature of the RAT rises to between −0.30° F. and 0.60° F. relative SPT, the compressor is placed into a 4 cylinder, low speed cooling mode for decreasing the RAT. And finally, if the RAT rises to the temperature above 0.6° F. over SPT, the compressor is placed into a 6 cylinder high or low speed mode for increased cooling to decrease RAT.

Figure 3:
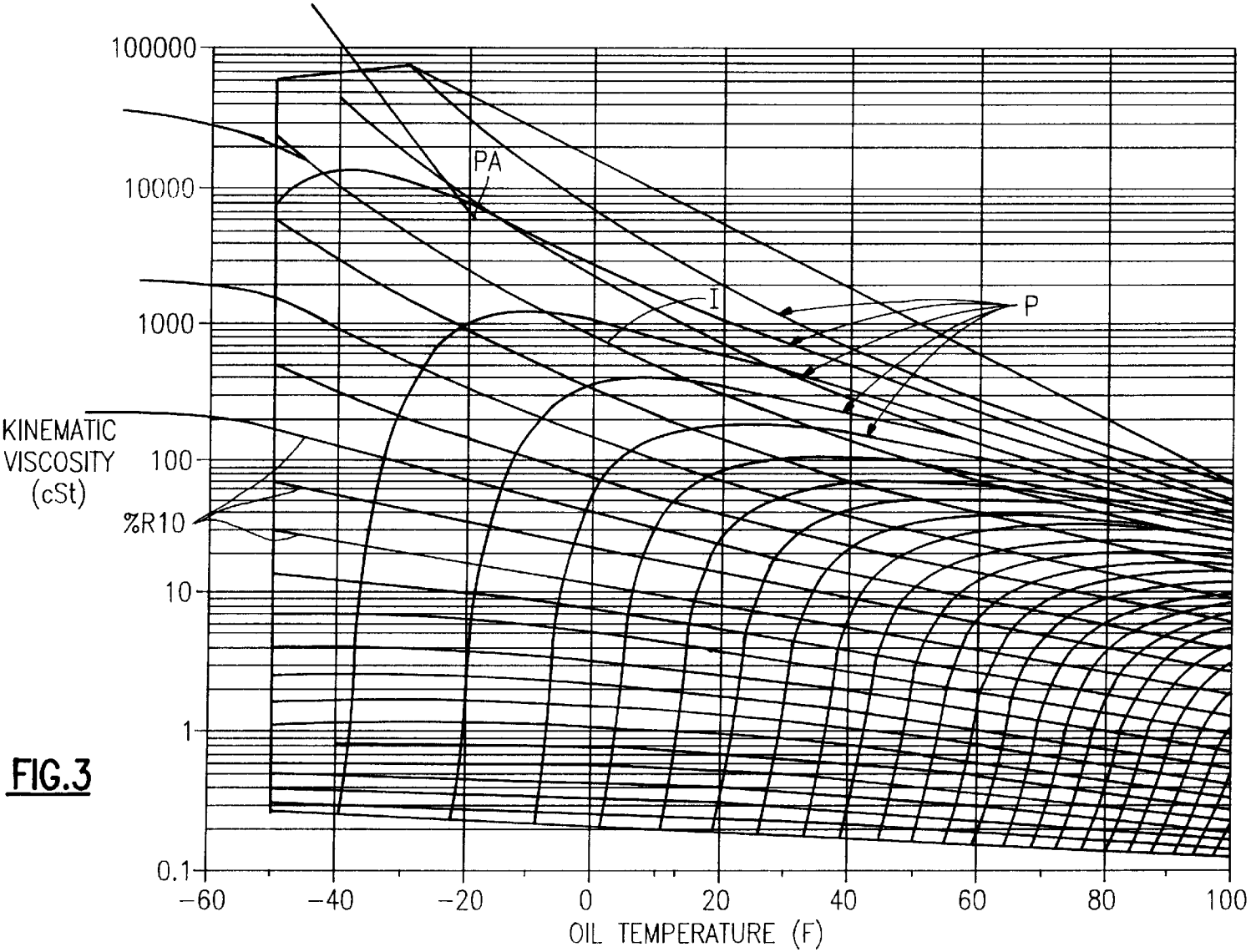
FIG. 3 is a Daniel Plot representing oil viscosity and temperature in relation to compressor suction pressure, refrigerant-in-oil percentage, and air temperature.
Figure 4:
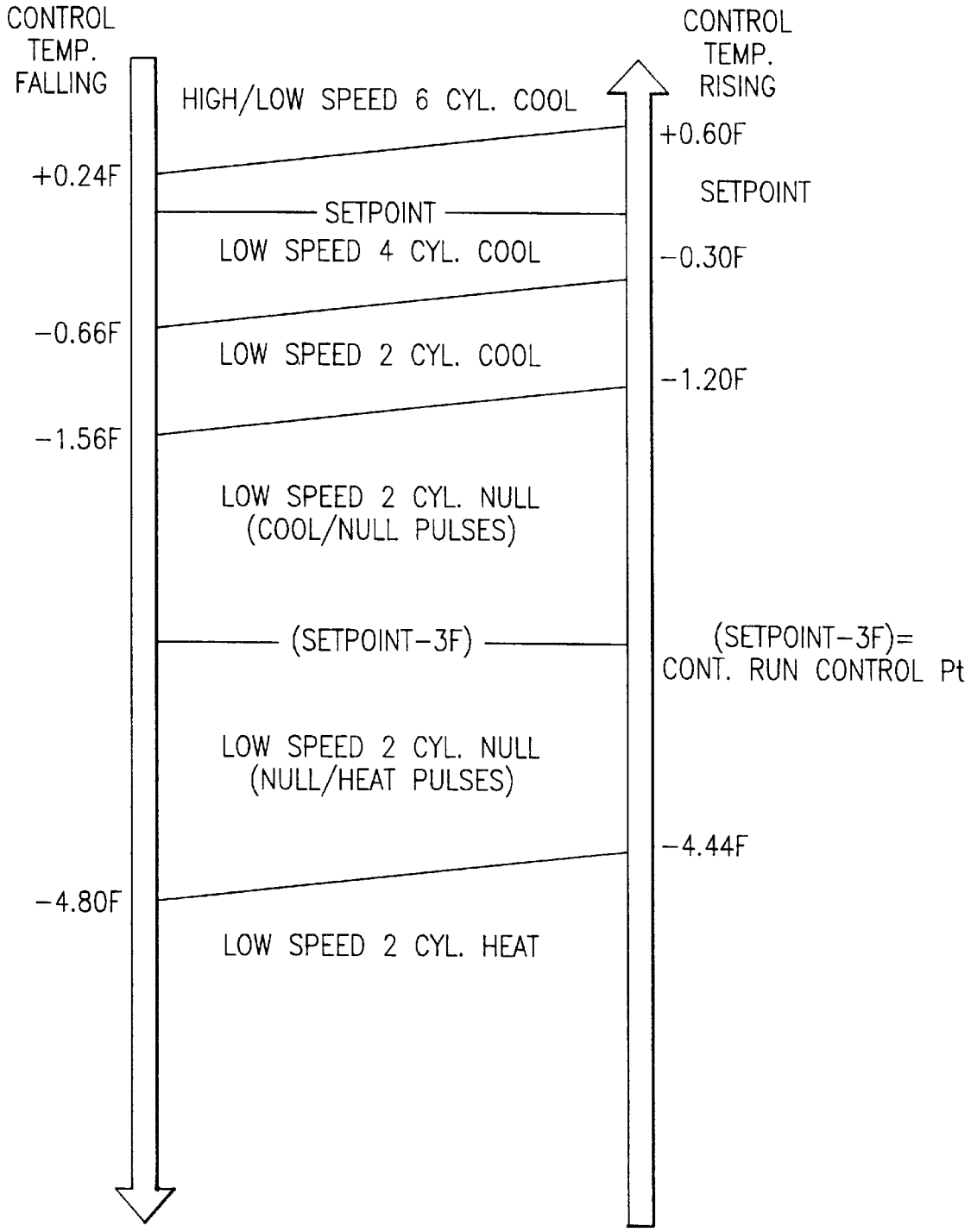
FIG. 4 is a ladder diagram of a specific embodiment of the method of the present invention as described in FIG. 1 for controlling oil viscosity for a transport refrigeration unit.

The FIG. 3 Daniel Plot represents the particular example as provided by the ladder diagram of FIG. 4. For a set point of −20° F., and maintaining the refrigeration compartment at set point −3.0° F., the suction pressure is increased to 25 PSIA, the oil temperature is approximately 0° F., and the RIO percentage is approximately 11–13%, yielding an oil viscosity for a Mobil EAL Artic/R404A, oil/refrigerant mixture, of 600 sCt.

The temperatures and viscosity's set forth above are provided by way of specific example only, and accordingly, can be varied depending on the SPT chosen and the oil viscosity desired for the particular compressor and oil being used. That is, for a chosen viscosity for optimal performance of a compressor, the desired temperature range around the SPT must be chosen and this may vary with the compressor and oil used.

The above embodiment has been described in relation to maintaining RAT within a desired range for controlling oil viscosity. However, the same method/system can be implemented by monitoring suction pressure and maintaining suction pressure toward a desired level, once a desired range around this level is reached. The suction pressure may be monitored by using a pressure transducer as the sensing device, shown as element 230 by the dotted lines in FIG. 2. Since suction pressure is related to the RAT, by monitoring the changes in suction pressure via the transducer, due to the refrigerant being pulsed into the evaporator, and maintaining the suction pressure at or around a desired pressure for a particular set point, such as in the range of 25±2 psi for the specific embodiment discussed above as determined by the Daniel Plot of FIG. 3, RAT and oil viscosity can be controlled to the desired levels. The flow chart and ladder diagram described above need only be altered to reflect suction pressure change based on compressor capacity changes and evaporator pulsing.

The primary advantage of this invention is that a system for controlling the viscosity of oil to a desired/optimal level in transport refrigeration applications is provided.

Another advantage of this invention is that a system to control the viscosity of oil in transport refrigeration systems is provided by carefully controlling the temperature in the refrigeration compartment to remain close to the desired freezing SPT, thereby raising the evaporator and suction pressure. Another advantage of this invention is that a system is provided for controlling oil viscosity level in a transport refrigeration system, by preventing RAT from dropping or rising more than within an ideal temperature range around a desired set point, in the continuous run and start/stop modes and by raising the evaporator and suction pressure to within a complimentary and desired range. Still another advantage of the present invention is that a system to control the viscosity of oil in transport refrigeration systems is provided by controlling the suction pressure in the evaporator to remain within a desired range, thereby maintaining RAT and the refrigerant-in-oil percentage within a desired range.

Although the invention has been shown and described with respect to the best mode embodiment thereof, it should be understood by those skilled in the art that the foregoing and various other changes, omissions, and additions in the form and detail thereof may be made without departing from the spirit and scope of the invention.

What is claimed is:

1. An oil viscosity control system for a refrigeration unit having an oil viscosity effecting parameter with a desired set point, the refrigeration unit including an oil lubricated compressor having a capacity and a suction pressure, a condenser, refrigerant control valves, and an evaporator connected in series, for circulating a refrigerant for adjusting air temperature of a compartment, comprising:

means for measuring the parameter;

means for controlling viscosity level of said oil so as not to interfere with proper operation of the compressor, including:

means for setting a parameter range inclusive of the desired set point in which the parameter is desired to fall, said range having a high point and a low point, wherein with the parameter in said range, viscosity of the oil is substantially at a desired level;

means for decreasing air temperature if based on said means for setting the parameter is higher than said high point;

means for increasing air temperature if based on said means for setting the parameter is lower than said low point; and means for maintaining said air temperature if based on said means for setting the parameter is within said desired range and toward said set point.

2. The system according to claim 1, wherein said means for decreasing comprises means for changing capacity of said compressor.

3. The system according to claim 2, wherein the compressor operates using a number of cylinders at a given speed, said means for changing capacity comprising means for adjusting the number of cylinders which operate and means for adjusting compressor speed such that as the temperature moves closer to within said range, the number of cylinders operating and the speed are reduced.

4. The system according to claim 1, wherein said means for increasing comprises means for changing capacity of said compressor.

5. The system according to claim 2, wherein the compressor operates using a number of cylinders at a given speed, said means for changing capacity comprising means for adjusting the number of cylinders which operate and means for adjusting compressor speed such that as the temperature moves closer to within said range, the number of cylinders operating and the speed are reduced.

6. The system according to claim 1, wherein the parameter is return air temperature, said means for maintaining comprising means for providing one of heating and cooling refrigerant pulses into the evaporator for maintaining said return air temperature within said desired range and toward said set point.

7. The system according to claim 6, wherein said refrigerant pulses are provided to said evaporator via said refrigerant control valves.

8. The system according to claim 1, wherein the parameter is suction pressure, said means for maintaining comprising means for providing one of heating and cooling refrigerant pulses into the evaporator for maintaining said suction pressure within said desired range and toward said set point.

9. The system according to claim 8, wherein said refrigerant pulses are provided to said evaporator via said refrigerant control valves.

10. A method for controlling oil viscosity in a refrigeration unit having an oil viscosity effecting parameter with a desired set point, the refrigeration unit including an oil lubricated compressor having a capacity and a suction pressure, a condenser, refrigerant control valves, and an evaporator connected in series, for circulating a refrigerant for adjusting air temperature of a compartment, comprising the steps of:

measuring the parameter;

controlling viscosity level of said oil so as not to interfere with proper operation of the compressor, including the steps of:

setting a parameter range inclusive of the desired set point in which parameter is desired to fall, said range having a high point and a low point, wherein with said parameter in said range, viscosity of the oil is substantially at a desired level;

cooling the air if based on said step of measuring the parameter is higher than said high point;

heating the air if based said step of measuring the temperature is lower than said low point; and maintaining said air temperature if based on said means for sensing the parameter is within said desired range and toward said set point.

11. The method according to claim 10, wherein said step of cooling comprises changing capacity of said compressor.

12. The method according to claim 11, wherein the compressor operates using a number of cylinders at a given speed, said step of changing capacity including adjusting the number of cylinders which operate and adjusting compressor speed such that as the temperature moves closer to within said range, the number of cylinders operating and the speed are reduced.

13. The method according to claim 10, wherein said step of heating comprises changing capacity of said compressor.

14. The method according to claim 13, wherein the compressor operates using a number of cylinders at a given speed, said step of changing capacity comprising adjusting the number of cylinders which operate and adjusting compressor speed such that as the temperature moves closer to within said range, the number of cylinders operating and the speed are reduced.

15. The system according to claim 10, wherein the parameter is return air temperature, said step of maintaining including providing one of heating and cooling refrigerant pulses into the evaporator for maintaining said return air temperature within said desired range and toward said set point.

16. The system according to claim 15, wherein said step of providing includes said refrigerant control valves providing said refrigerant pulses to said evaporator.

17. The system according to claim 10, wherein the parameter is suction pressure, said step of maintaining including providing one of heating and cooling refrigerant pulses into the evaporator for maintaining said suction pressure within said desired range and toward said set point.

18. The system according to claim 17, wherein said step of providing includes said refrigerant control valves providing said refrigerant pulses to said evaporator.

* * * * *